United States Patent [19]

Greene

[11] Patent Number: 5,040,772

[45] Date of Patent: Aug. 20, 1991

[54] RIDER PROTECTION SYSTEM

[76] Inventor: William S. Greene, 813 Brookhill Rd., Louisville, Ky. 40223

[21] Appl. No.: 481,291

[22] Filed: Feb. 20, 1990

[51] Int. Cl.[5] ..... E04H 17/00

[52] U.S. Cl. ..... 256/59; 256/12; 256/1

[58] Field of Search ..... 256/14, 15, 16, 59, 256/65, 1, 12

[56] References Cited

U.S. PATENT DOCUMENTS

| | | | |
|---|---|---|---|
| 3,638,913 | 2/1972 | Persicke | 256/13.1 |
| 4,443,002 | 4/1984 | Fontana | 256/59 |
| 4,635,905 | 1/1987 | Fontana | 256/59 |

*Primary Examiner*—Robert J. Spar

*Assistant Examiner*—Craig Slavin

*Attorney, Agent, or Firm*—Edward M. Steutermann

[57] ABSTRACT

A protection system to prevent or minimize likelihood of injury to a rider at a racetrack if the jockey is thrown over the rail which surrounds the track. Usually the rail is supported by a curved post which extends upwardly from the ground and inwardly toward the track. A series of deflector panels are provided along the rail and are biased to generally horizontal position adjacent the rail by a coil spring device so that when a rider is thrown over the rail and contacts the deflector device the deflector then moves downwardly in response to the impact of the rider. The deflector then return to a generally horizontal position by the bias device after the rider has rolled off of the deflector.

2 Claims, 2 Drawing Sheets

RIDER PROTECTION SYSTEM

BACKGROUND OF THE INVENTION

The present invention relates, in general, to racetrack safty devices and more particularly relates to a deflector system for use with the rails on a racetrack. In general the rails of the track are generally supported posts which are embedded in the ground and curved inwardly toward the track.

The danger encountered in connection with rail systems of this type is that a rider thrown over the rail may strike a supporting post and suffer severe injury. The prior art has recognized the potential for injury, and U.S. Pat. Nos. 4,443,002 and 4,635,905 Fontana deal with the problem in one regard by providing inwardly extending aprons around the rails. However, the aprons are secrued at their inner and outer edges so do not deflect on impact. Similar systems were known and installed at Santa Anita and Hollywood Park racecourse in California prior to the Fontana references.

In cases of the prior art, however, the apron is secured on the inside and outside so in effect a "shelf" is formed.

No prior art reference is known which teaches the benefits and advantages found in connection with devices in accordance with the present invention where a series of deflector panels are utilized.

SUMMARY OF THE INVENTION

The present invention provides a new, useful, and highly effective arrangement for minimization of the likelihood of injury to a jockey in the event the jockey is thrown from a horse and over a rail ajoining the track.

As previously stated the danger in such an occurrence is that a jockey thrown over the rail will strike a curved post which holds the rail and thus suffers severe injury.

The devices within the scope of the present invention recognize that it is desirable in providing an arrangement which allows flexure of the deflector device to cushion the impact relized by a jockey who is thrown over a rail from a horse. Accordingly, devices within the scope of the present invention provide edge interleaved deflector panels, which can be of any selected material of strength and reinforcement sufficient to accomplish the purposes for which the devices are intended. The delector planels are pivotable adjoined to the rail and a spring bias device is provided to maintain the deflectors in generally horizontal position.

However, upon impact by a jockey the panel is free to move so that the end of the panel rotates toward thus, lessening the serverity of the impact and directing the jockey toward the ground.

More particularly, devices within the scope of the present invention provide a protection system to prevent or minimize injury to a jockey at a racetrack when a jockey is thrown over the rail which surrounds the track and where the rail is supported by a curved post which extends upwardly from the ground and extends inwardly toward the track where a series of deflector panels are provided along the rail and are biased toward the rail by a coil spring device so that a rider thrown over the rail contacts the deflector device which then moves downwardly in response of the weight of the rider and where the deflector is then returned to a generally horizontal position by the bias device after the rider has rolled off of the reflector.

Examples of devices within the scope of the present invention are illustrated in the accompanying drawings and described hereinafter but it will be understood that various other arrangements also within the scope of the present invention will occur to those skilled in the art upon reading the disclosure set forth hereinafter.

BRIEF DESCRIPTION OF THE DRAWINGS

Referring now to the drawings which illustrate an example of and arrangement within the scope of the present invention.

DETAILED DESCRIPTION OF THE DRAWINGS

Figure 1:
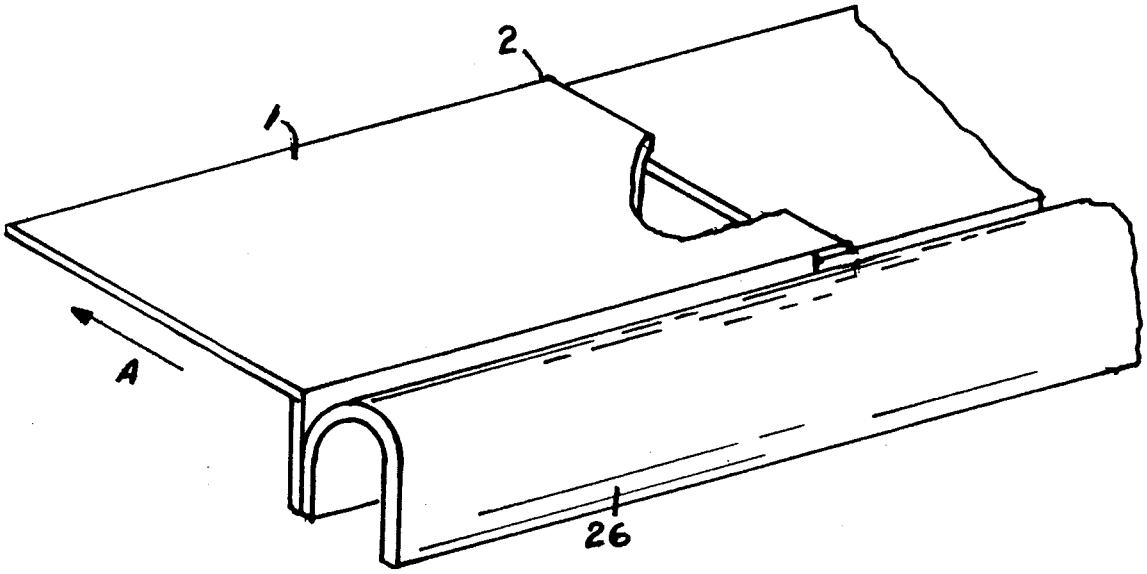
FIG. 1 is a perspective view of a segment of an example of an arrangement within the scope of the present invention.

FIG. 1 shows a perspective view of a segment of a rail with a deflector apron within the scope of the present invention. In FIG. 1 the rail 26, which can be supported above the track as described with reference to FIG. 2 has apron panels 1 connected to one side as shown and described in detail hereinafter.

In FIG. 1 the panels are shown to be located on the inside of the track but it will be understood that panels can be located on the side of the rails opposite the track.

In the example shown in FIG. 1 the panels have been installed for protection where movement is in the direction shown by arrow A. In this regard the panel 1 shown has an overlap section 2 which overlaps the next panel so that if the rider impacts on the first panel, the first and second panels are deflected to break his fall and direct him to the ground. Without the overlap, or its equivalent, the first panel would defelct and guide the rider into the second panel.

Figure 2:
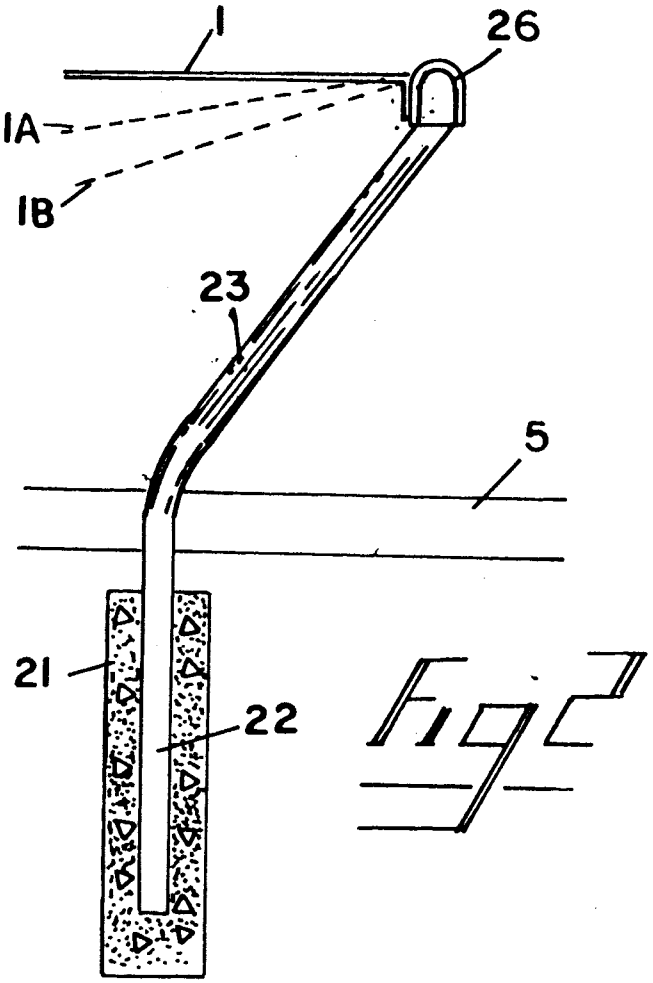
FIG. 2 is an elevational view of the assembly of the type described in reference to FIG. 1.

Referring now to FIG. 2, a full view of a cross section if an example of a system is shown wherein a post 22 is shown imbeded in support material for example concrete 21. A curved portion 23 is provided for the post 22 to extend inwardly over the track 24. A rail 26, an example of which is described hereinafter, is provided atop the post 23 to deflect on impact as shown by dotted lines 1A and 1B. It will be understood, as is know in the art, that a series of posts are provided around the track and rail 26 likewise extends generally continuously around the track.

A deflector panel 1 is shown with the deflector panel 1 extending generally horizontally from the rail 26. However the panels can be disposed at various angles and inclination 1A or 1B as may be desirable depending upon the application and asthetics of the course.

Any convenient width panel can be used but in any event the length should be sufficient to divert a jockey in a direction so that he does not contact any part of the posts 23.

Figure 3:
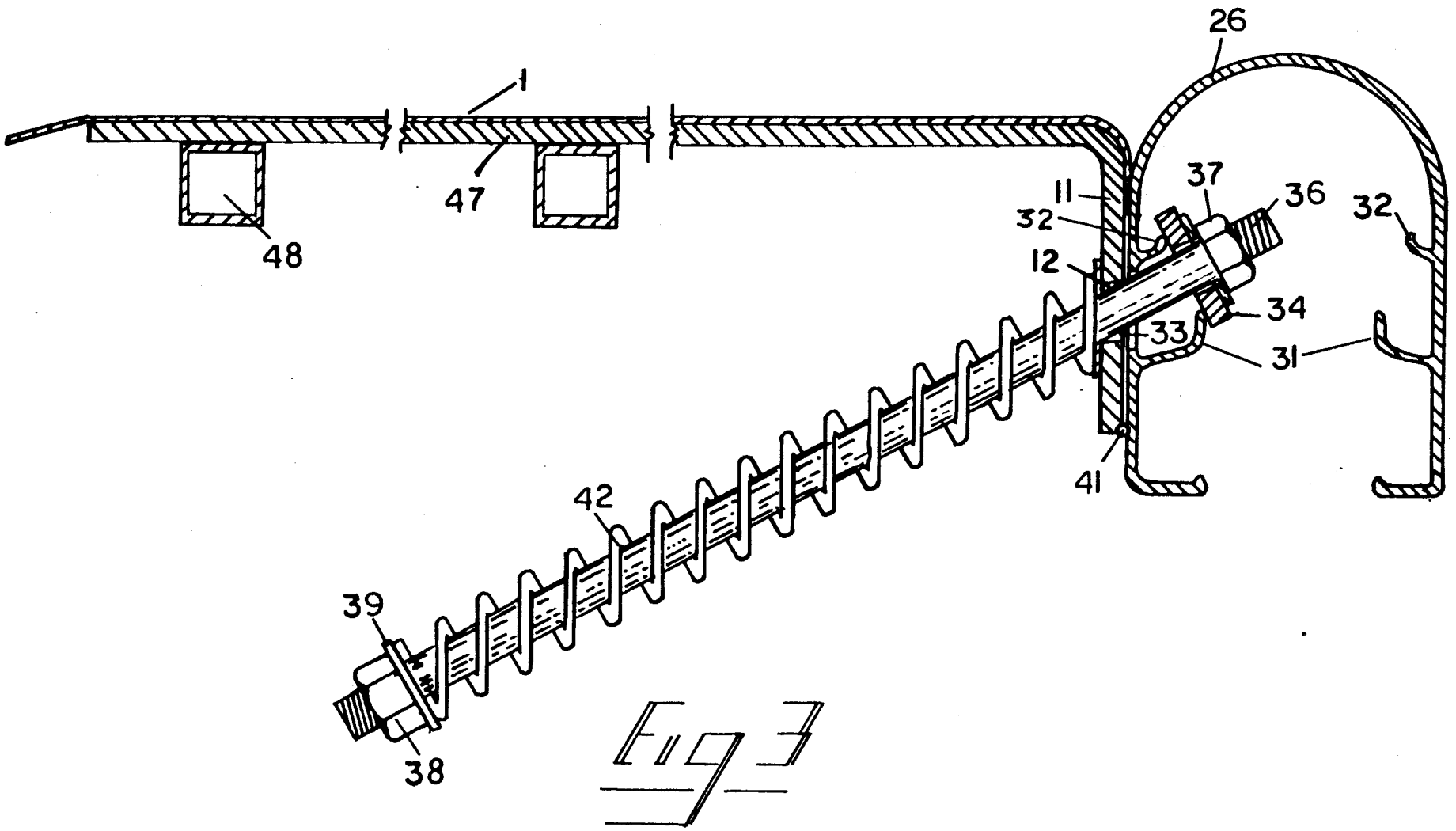
FIG. 3 is an enlarged cross sectional view of one example of a deflector panel and bias means useful in devices within the scope of the present invention.

FIG. 3 is a cross sectional view illustrating the operational aspects of an example of a device within the scope of the present invention. As shown the rail 26 can be of any convenient description but is usually of extruded aluminum.

In the arrangement shown the rail 26 has internal expansion ribs 32 and a cable tray 31 on either side of the inside of the rail. The cable tray is typically utilized to carry telemetery equipment. In the arrangement shown an aperture 33 has been provided in the side of the rail between the rib 32 and the cable tray 31. A plate 34 is located to abut the inter surfaces of the rib and the cable tray.

As also shown the deflector plate 1 has a down turned leg 11 with an aperture 12 which is also to adapted to receive a shaft 36 secured at one end by a nut 37. The shaft 36 extends through an aperture 12 and 33 of leg 11 and rail 26 at an angle determined by the configuration of the rib 32 and the cable tray 31.

In the arrangement shown the cable tray and rail are utilized as a means for seating the spring bias device described hereinafter but it will be understood that other arrangements also within the scope of the present invention are contemplated and the particular aspects of the bias system shown are not by way of limitation. Any suitable bias system can be utilized within the scope of the present invention.

Turning again to the illustrated bias system a washer 37 and nut 38 are provided on the opposite end of shaft 36 within rail 26 and compression spring 42 is provided between the washer 37 and the inner surface of the of the leg 11. Thus, by adjusting the nuts 37 or 38 the compression of spring 42 can be adjusted to determine the rest position of the deflector plates as shown in FIG. 2.

A fulcrum 41 is defined between the end of the leg 11 and the outer surface of the rail 26. The deflector then pivots about this fulcrum point upon impact by a rider thus to cushion the impact and allow the rider to be directed toward the ground.

In the arrangement shown the deflector plate 1 consists of an upper panel 46 with a lower support 47 located at the overlap between adjacent panels. As previously described additional structual statability can be provided by support members 48 which can be located beneath the supports 47. It will be understood that support can be provided at each end of each panel.

Additionally, each of the panels is independently deflectable but the panels can be interleaved as shown in FIG. 1 in order to prevent the depression of one panel and the rider being directed into the end of a subsequent panel.

It will be understood that the foregoing are but a few arrangements within the scope of the present invention and that various other arrangements also within the scope of the present invention will occur to those skilled in the art upon reading the disclosure set forth hereinbefore.

The invention claimed is:

1. A protection system to prevent or minimize injury to a jockey at a racetrack when a jockey is thrown over a rail which surrounds the track and where said rail is supported by a curved post which extends upwardly from the ground and extends inwardly toward the track including a series of deflector panels located along said rail on the side of said rail opposite said track and are connected to said rail by a spring device where said deflector panels have a base panel with a transversely extending leg located along a portion of one edge thereof and where said transversely extending leg is adapted to be located adjacent said rail and said spring device extends through said leg to hold said base panel in generally horizontal orientation so that a rider thrown over the rail contacts the deflector panel which then moves downwardly in response to the weight of the rider and is then returned to a generally horizontal position by said spring device after the rider has rolled off of said deflector panel.

2. The invention of claim 1 wherein an edge of a portion of said base panels adjacent said leg overlap and adjacent edge of an adjacent panel.

* * * * *